US007383000B2

(12) United States Patent
Koumoto et al.

(10) Patent No.: US 7,383,000 B2
(45) Date of Patent: Jun. 3, 2008

(54) PROCESS CARTRIDGE AND IMAGE FORMING APPARATUS

(75) Inventors: Mitsuhiro Koumoto, Utsunomiya (JP); Tadashi Hirata, Tadashi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 44 days.

(21) Appl. No.: 11/277,189

(22) Filed: Mar. 22, 2006

(65) Prior Publication Data

US 2006/0216064 A1 Sep. 28, 2006

(30) Foreign Application Priority Data

Mar. 25, 2005 (JP) ..... 2005/088056

(51) Int. Cl.
*G03G 21/16* (2006.01)

(52) U.S. Cl. ..... 399/111; 399/113; 399/114; 399/116; 399/119

(58) Field of Classification Search ..... 399/111, 399/116, 119, 113, 114
See application file for complete search history.

(56) References Cited

U.S. PATENT DOCUMENTS 5,974,288 A * 10/1999 Sato ..... 399/119
6,226,477 B1 5/2001 Kurosawa et al.
6,246,854 B1 6/2001 Kurosawa et al.
6,324,352 B1 11/2001 Suzuki
6,347,204 B1 2/2002 Kurosawa
6,366,749 B1 4/2002 Koumoto
6,643,482 B2 * 11/2003 Higeta et al. ..... 399/109
6,728,500 B2 4/2004 Naito et al.
6,763,209 B2 * 7/2004 Higeta et al. ..... 399/109
7,206,534 B2 * 4/2007 Murakami ..... 399/103
2003/0156855 A1 * 8/2003 Nittani et al. ..... 399/106
2005/0249519 A1 * 11/2005 Chadez ..... 399/106

FOREIGN PATENT DOCUMENTS

JP 9-127851 5/1997

OTHER PUBLICATIONS

English translation of Endo (JPO pub # 09-127851).*
English Language Abstract of JP 9-127851.

* cited by examiner

*Primary Examiner*—David M Gray
*Assistant Examiner*—Geoffrey T Evans
(74) *Attorney, Agent, or Firm*—Greenblum & Bernstein, P.L.C.

(57) ABSTRACT

When the user inserts an insertion end portion of an image forming unit covered with a protective cover into an attachment opening on an apparatus main unit along with a buffer sheet and a blackout sheet, the insertion end portion of an exterior cover sheet touches an exterior wall near the attachment opening for the image forming unit on the apparatus main unit. Thereby, the insertion operation of the image forming unit stops and one end of the image forming unit is held supported on the wall inside the opening.

19 Claims, 9 Drawing Sheets

PROCESS CARTRIDGE AND IMAGE FORMING APPARATUS

BACKGROUND OF THE INVENTION

1. Field of the Invention

The present invention relates to a process cartridge and an image forming apparatus, particularly to a process cartridge for a copier, a facsimile machine, a printer and the like that use one of electronic photography and electrostatic recording methods and an image forming apparatus that uses the process cartridge.

2. Description of Related Art

Conventionally, when a drum cartridge is supplied to users as a process cartridge for a copier, a facsimile machine, a printer and the like that use one of electronic photography and electrostatic recording methods, a plastic cover member that covers the drum cartridge is attached to protect a drum portion of a new cartridge from possible damage during replacement process.

An example of the process cartridge having the cover member of the above-described type is disclosed in Related Art 1. When the process cartridge is inserted into an apparatus, an interference portion provided on a protective cover touches the apparatus and thereby stops only the protective cover so as to prevent the protective cover from being pushed inside. Cartridge insertion is complete while the protective cover protrudes from the process cartridge.

[Related Art 1] Japanese Patent Laid-open Publication Hei 9-127851

The process cartridge of Related Art 1, however, has the protective cover, made of plastic or another material, that covers an entire exposed portion of a photoconductive drum and that has a guiding portion or the like formed in one piece, which slides and fits into a cartridge frame. The process cartridge thereby occupies a space and requires manufacturing costs for the protective cover, which increases costs of the expendable process cartridge.

Further, the cartridge frame is provided with a protective cover guide that slides and fits into the guiding portion of the protective cover, thus leading to a further cost increase of the process cartridge. Furthermore, the protective cover becomes unnecessary after being inserted into the apparatus, causing an environmental protection issue.

SUMMARY OF THE INVENTION

An object of the present invention is to provide a process cartridge and an image forming apparatus, wherein the process cartridge has a low-cost and easily disposable cover member having a minimum size that protects a photoconductive drum portion and that prevents damage in replacement, while requiring no plastic cover member that covers the entire process cartridge, and wherein the image forming apparatus uses the process cartridge.

In the present invention, the process cartridge, having a photoconductive drum therein and attachable to/detachable from the image forming apparatus, is provided with a sheet-type cover member. The cover member, which protects the photoconductive drum, is attached to the cartridge until the cartridge is inserted halfway into the image forming apparatus. The cover member is then removed from the cartridge when the cartridge touches an exterior wall of the image forming apparatus as the cartridge is being inserted into the image forming apparatus.

The sheet-type cover member according to the present invention no longer requires the image forming apparatus to have a cover guide or the like that slides and fits into the cover member, thereby allowing manufacturing of the cover member at a lower cost than that of a plastic product. Further, while the process cartridge is inserted into the apparatus, the insertion operation stops, allowing a user to know a timing to remove the cover member. Furthermore, the user is able to easily remove and dispose of the cover member.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 5 (*b*) illustrates the second procedure for manufacturing the protective cover according to the embodiment and shows a plain view of the rear side of the exterior cover sheet to which the buffer sheet is adhered;

FIG. 6 (*b*) illustrates the third procedure for manufacturing the protective cover according to the embodiment and shows a plain view of the rear side of the buffer sheet to which the blackout sheet is adhered;

DETAILED DESCRIPTION OF PREFERRED EMBODIMENTS

The embodiments of the present invention are explained in the following, in reference to the above-described drawings.

Figure 1:
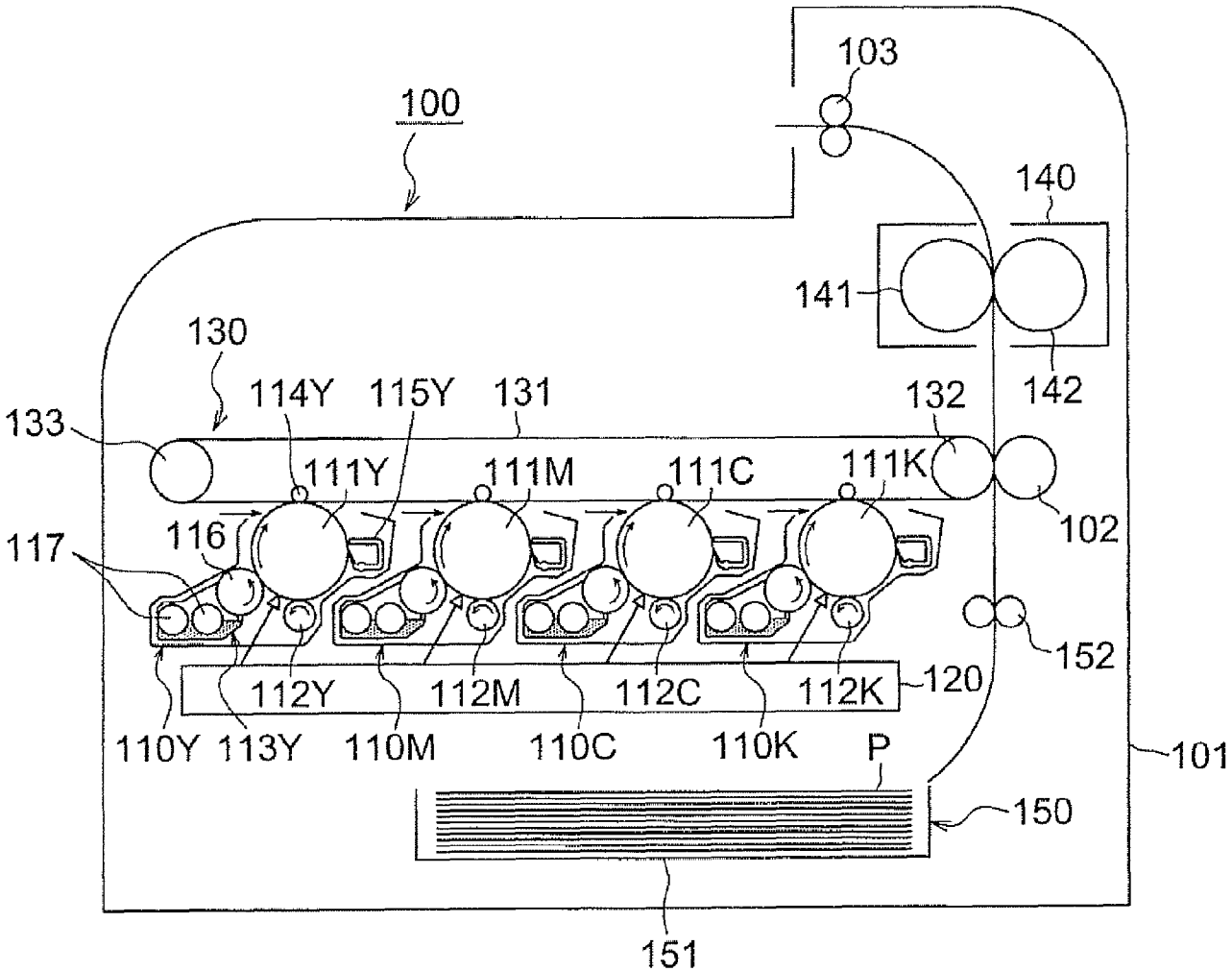
FIG. 1 is a schematic view illustrating an entire structure of an image forming apparatus according to an embodiment of the present invention.

FIG. 1 is a schematic view illustrating an entire structure of an image forming apparatus according to an embodiment of the present invention. Image forming apparatus 100 according to the embodiment includes image forming units 110Y, 110M, 110C and 110K; laser scanning unit (LSU) 120; intermediate transfer unit 130; fuser unit 140; paper feeder 150; and the like.

Image forming unit 110Y includes photoconductive drum 111Y, charged roller 112Y, developer unit 113Y, primary transfer roller 114Y and photoconductive drum cleaner 115Y. Image forming unit 110Y forms a toner image in yellow (Y) on photoconductive drum 111Y. Developer unit 113Y is filled with a two-component developer including a toner and a carrier and is provided with developer roller 116 and mixing screw 117.

Other image forming units 110M 110C and 110K have the same structure as image forming unit 110Y; that is, charged rollers 112M, 112C and 112K are provided and developer units 113M, 113C and 113K are filled with toners in magenta (M), cyan (C) and black (K) respectively.

Laser scanning unit 120 irradiates photoconductive drums 111Y, 111M, 111C and 111K of image forming units 110Y, 110M, 110C and 110K with respective laser beams. The laser beams are separated into four colors through a polygon mirror, an f-θ lens, a reflective mirror, an imaging lens and the like, which are not shown in the figure.

Intermediate transfer unit 130 includes intermediate transfer belt 131, driving roller 132 and driven roller 133. Intermediate transfer belt 131 is rotatably mounted on driving roller 132 and driven roller 133. Driving roller 132 rotates intermediate transfer belt 131 in the direction of an arrow.

Fuser unit 140 includes fuser roller 141 and pressure roller 142, as well as an exciting coil unit and the like, which are not shown in the figure. Fuser roller 141 and pressure roller 142 revolve while pressuring each other to form a nip.

Paper feeder 150, provided at a lower part of apparatus main unit 101, includes paper cassette 151 that holds sheets of papers P. A pickup roller and a separator roller, which are not shown in the figure, separate and feed a sheet of paper one by one from a stack of papers P in paper cassette 151.

As shown in FIG. 1, photoconductive drums 111Y, 111M, 111C and 111K of image forming units 110Y, 110M, 110C and 110K respectively are revolved in a predetermined direction at a predetermined timing by a driving system, which is not shown in the figure. Then, a predetermined electric potential is sequentially charged to surfaces of photoconductive drums 111Y, 111M, 111C and 111K by charged rollers 112Y, 112M, 112C and 112K.

The charged surfaces of photoconductive drums 111Y, 111M, 111C and 111K are then sequentially exposed by the laser beams from laser scanning unit 120. Thereby, electrostatic latent images in respective colors are developed on the surfaces of photoconductive drums 111Y, 111M, 111C and 111K.

The electrostatic latent images in each color formed on the surfaces of respective photoconductive drums 111Y, 111M, 111C and 111K are sequentially developed with thinly layered toners in four colors, that is, yellow, magenta, cyan and black, and formed into toner images in four colors. The toners are mixed by mixing screw 117 of respective developer unit 113Y (113M, 113C and 113K) and supplied by developer roller 116.

The toner images in four colors formed on the surfaces of respective photoconductive drums 111Y, 111M, 111C and 111K are then primarily transferred, that is, sequentially layered onto an image transfer surface (exterior circumference surface) of rotating intermediate transfer belt 131 by primary transfer roller 114Y (114M, 114C and 114K). Thereby, a full color image is formed on the image transfer surface of intermediate transfer belt 131.

The full color image primarily transferred onto intermediate transfer belt 131 is transferred at one time (secondary transfer) onto a sheet of paper P by secondary transfer roller 102. The sheet of paper P is supplied from paper feeder 150 and positioned by registration roller 152 for recording.

The full color image secondarily transferred onto the sheet of paper P is fused by a nip of fuser unit 140. Then, the sheet of paper P is ejected by paper ejecting roller 103 onto a paper ejection tray provided on an upper part of apparatus main unit 101.

Image forming units 110Y, 110M, 110C and 110K are drum cartridges (process cartridges) attachable to and detachable from apparatus main unit 101. A single unit structure of the image forming unit before attached to apparatus main unit 101 is described below in reference to FIG. 2.

Figure 2:
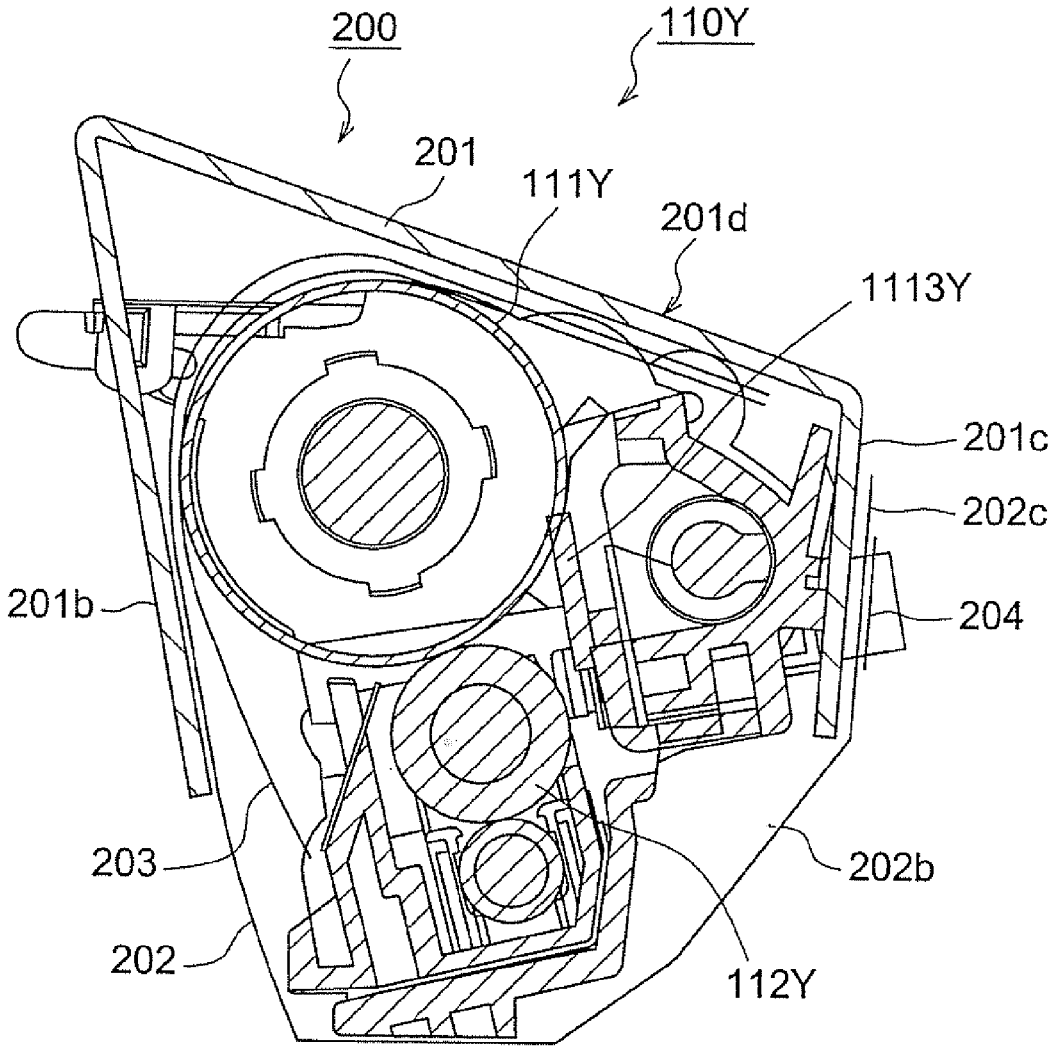
FIG. 2 is a cross-sectional view illustrating a structure of a single unit of the image forming apparatus according to the embodiment.

FIG. 2 is a cross-sectional view of image forming unit 110Y from a front end portion in a longitudinal direction of the figure, illustrating a structure of image forming unit 110Y before attached to apparatus main unit 101. Image forming units 110M, 110C and 110K have the same internal structure as image forming unit 110Y.

As shown in FIG. 2, image forming unit 110Y includes above described photoconductive drum 111Y; charged roller 112Y; cleaning blade 1113Y, which removes toner residue on the surface of photoconductive drum 111Y after toner image transfer; and the like. A substantially entire circumference of image forming unit 110Y before attached to apparatus main unit 101 is covered with protective cover 200. Protective cover 200 includes: exterior cover sheet 201 that covers image forming unit 110Y from its upper part to the middle of its both sides in the figure; buffer sheet 202, located inside exterior cover sheet 201, that covers the substantially entire circumference of image forming unit 110Y from its lower part in the figure; and blackout sheet 203 that mainly covers an exposed portion of photoconductive drum 111Y.

Image forming unit 110Y is inserted from another end portion in the longitudinal direction into an opening (not shown in the figure) for image forming unit 110Y attachment provided on apparatus main unit 101. Procedures for attaching image forming unit 110Y to apparatus main unit 101 will be described later in detail in reference to FIGS. 7 to 9.

For protective cover (cover member) 200, exterior cover sheet 201 is made of a cardboard sheet; buffer sheet 202, as buffer material, is made of a foamed polyethylene sheet; and blackout sheet 203 is made of a light-shielding polyethylene sheet (e.g., colored in black) that substantially completely shuts out light. The sheets have shapes as shown in a plain view of FIG. 3.

Figure 3:
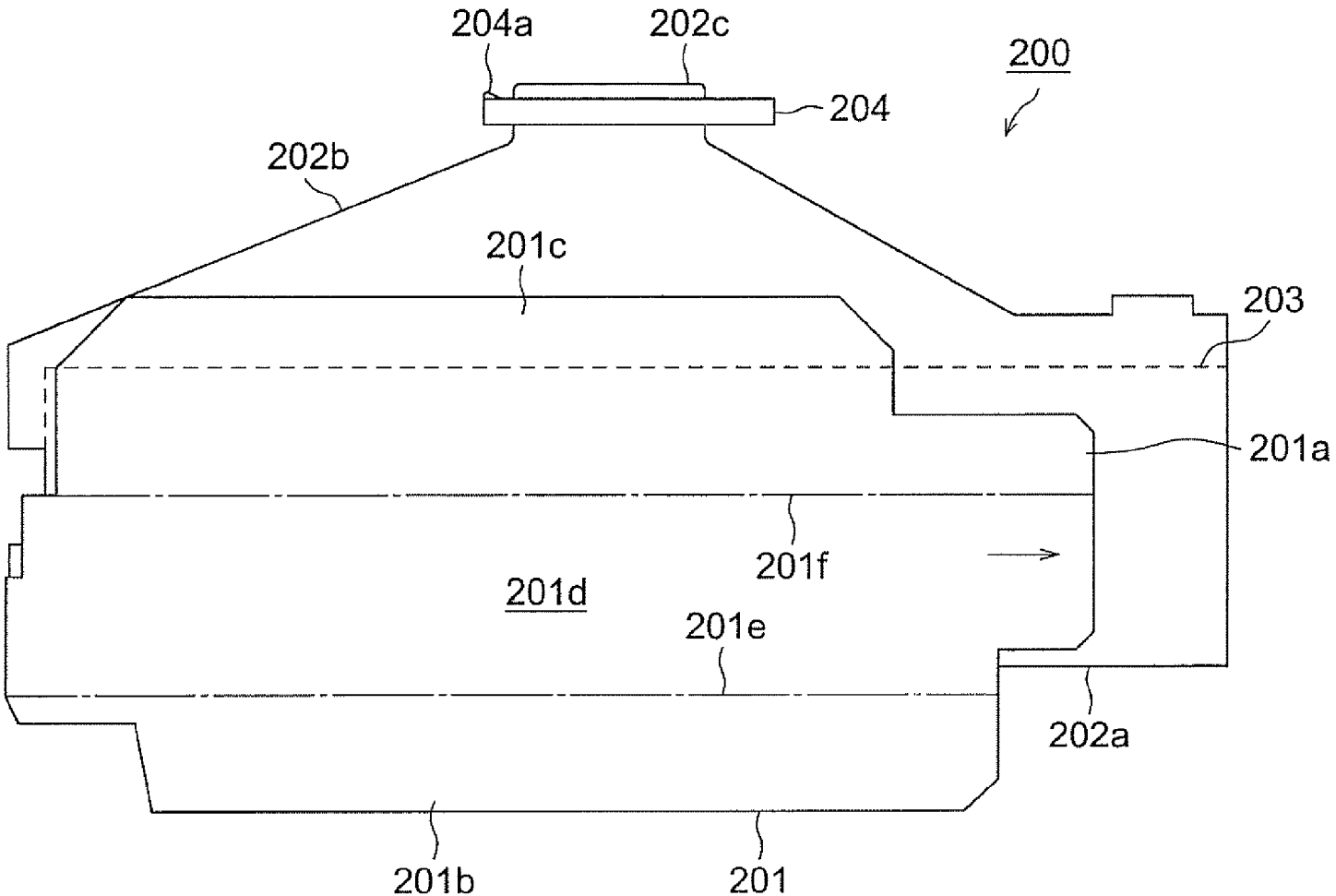
FIG. 3 illustrates a structure of a protective cover according to the embodiment.

FIG. 3 illustrates sheets 201 to 203 of protective cover 200 unfolded on a same flat surface. Protective cover 200 has a three layer structure, in which the sheets are layered in an order of exterior cover sheet 201, buffer sheet 202 and blackout sheet 203 from a top view. Assembly procedures of protective cover 200 are described below in reference to FIGS. 4 to 6.

Figure 4:
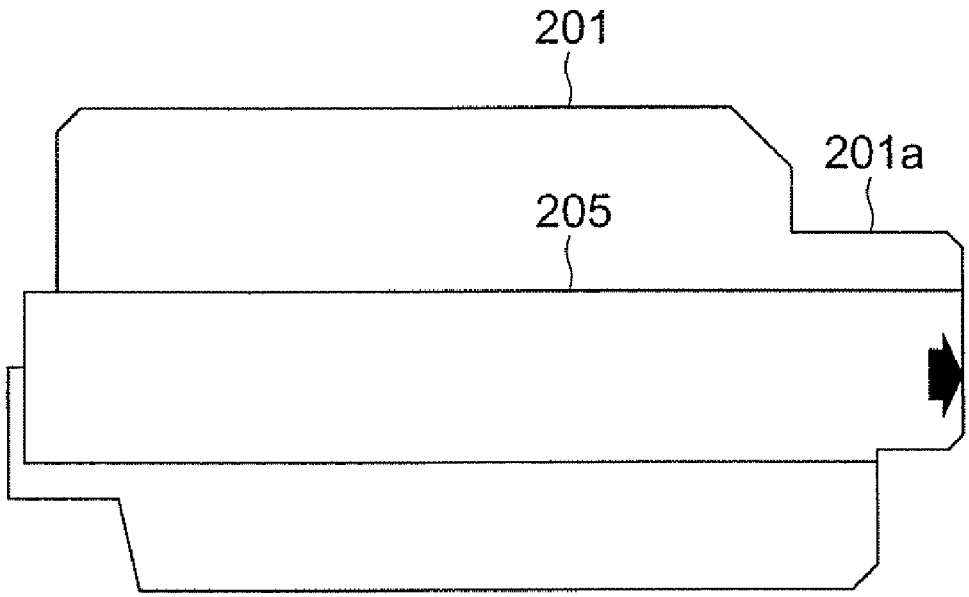
FIG. 4 is a front side plain view of an exterior cover sheet illustrating a first procedure for manufacturing the protective cover according to the embodiment.

FIG. 4 is a front side plain view of exterior cover sheet 201, illustrating a first assembly step of protective cover 200. In the first assembly step shown in FIG. 4, label 205 is adhered to a position on exterior cover sheet 201 as shown in the figure. An arrow is printed on label 205 so as to indicate a direction to insert image forming unit 110Y into apparatus main unit 101. Exterior cover sheet 201 is made of one sheet of cardboard. 201*a* in the figure is an insertion end portion that indicates the direction to insert image forming unit 110Y into the opening for image forming unit 110Y attachment on apparatus main unit 101.

Figure 5A:
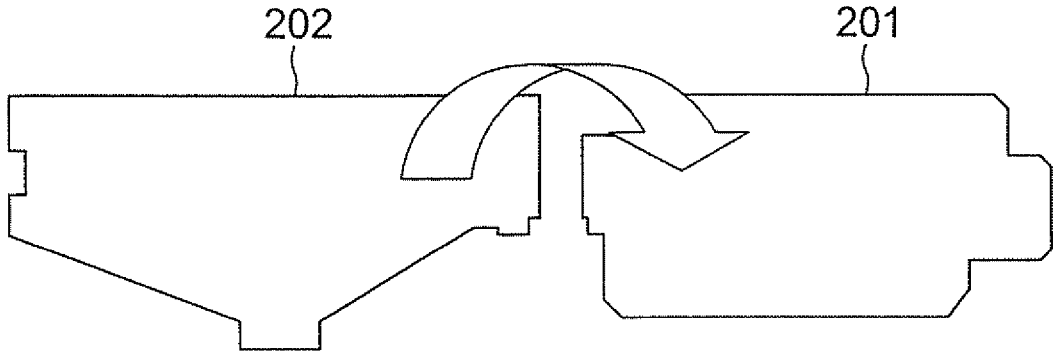
FIG. 5 (*a*) illustrates a second procedure for manufacturing the protective cover according to the embodiment and shows a plain view of a rear side of a buffer sheet and the exterior cover sheet.
Figure 5B:
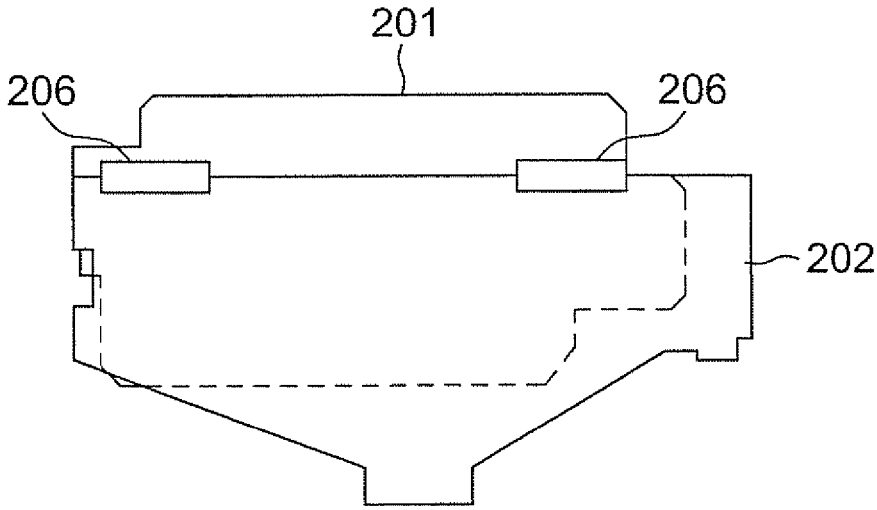

FIGS. 5 (*a*) and 5 (*b*) show a second assembly step of protective cover 200. FIG. 5 (*a*) is a rear side plain view of buffer sheet 202 and exterior cover sheet 201; FIG. 5 (*b*) is a plain view illustrating the rear side of exterior cover sheet 201 to which buffer sheet 202 is adhered. In the second assembly step shown in FIG. 5 (*b*), buffer sheet 202 is placed on a position shown in the figure illustrating the rear side of exterior cover sheet 201 and adhered using two pieces of adhesive tape 206. Buffer sheet 202 is made of one sheet of foamed polyethylene that absorbs shock and easily cuts in one direction.

Figure 6A:
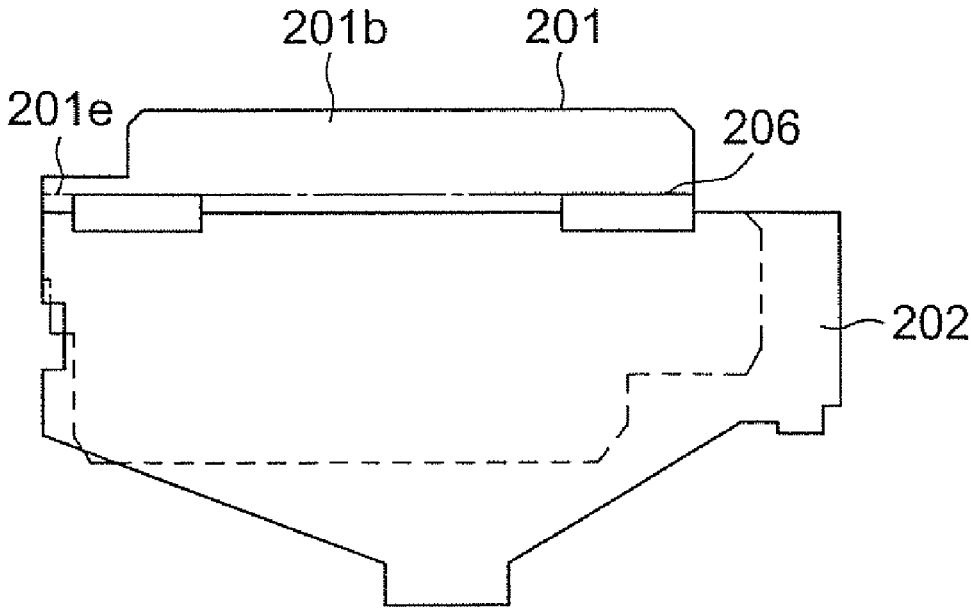
FIG. 6 (*a*) illustrates a third procedure for manufacturing the protective cover according to the embodiment and shows a plain view of the rear side of the exterior cover sheet to which the buffer sheet is adhered.
Figure 6B:
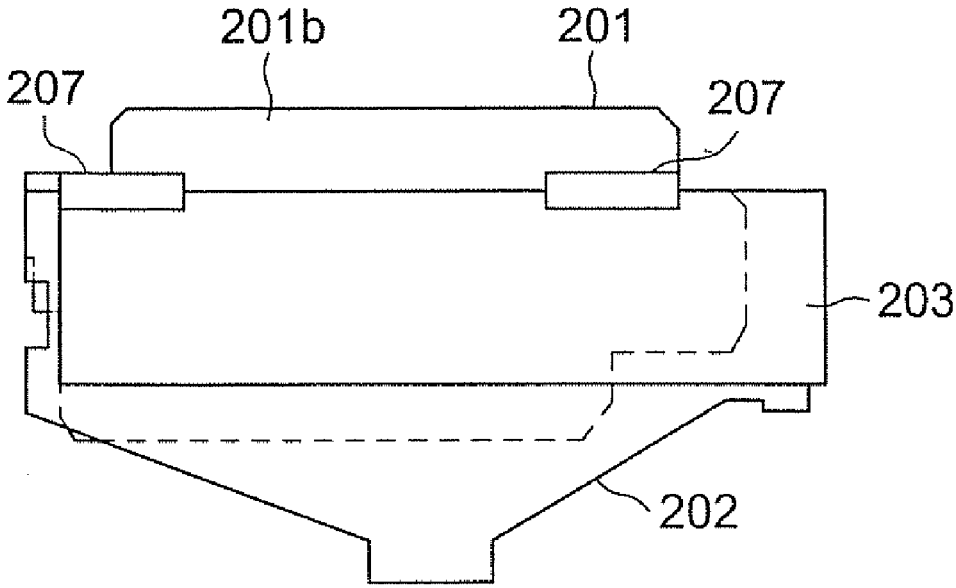

FIGS. 6 (*a*) and 6 (*b*) show a third assembly step of protective cover 200. FIG. 6 (*a*) is a plain view illustrating the rear side of exterior cover sheet 201 to which buffer sheet 202 is adhered; FIG. 6 (*b*) is a plain view illustrating the rear side of buffer sheet 202 to which blackout sheet 203 is adhered.

As FIG. 6 (*a*) shows, exterior cover sheet 201 has folding line 201*e* indicated in the figure as a dashed line. Folding along folding line 201*e* forms holding portion 201*b*, which will be described later. As FIG. 6 (*b*) shows, blackout sheet 203 is placed on a position shown in the figure illustrating the rear side of buffer sheet 202, with reference to folding line 201*e*. Blackout sheet 203 is then adhered using two pieces of adhesive tape 207. Blackout sheet 203 is made of one sheet of light-shielding polyethylene colored black that substantially completely shuts out light.

Functions of sheets 201 to 203 of protective cover 200 assembled as above are described below in reference to FIGS. 2 and 3. FIG. 3 does not show label 205 illustrated in FIG. 4.

As shown in FIG. 3, exterior cover sheet 201 includes insertion end portion 201 a; holding portions 201*b*, 201*c* and 201*d*; and folding lines 201*e* and 201*f*. Insertion end portion 201*a* on the right side in the figure touches an exterior wall of apparatus main unit 101, as the insertion end portion of image forming unit 110Y is inserted into the opening (not shown in the figure) on apparatus main unit 101 for image forming unit 110Y attachment in the direction of an arrow, along with buffer sheet 202 and blackout sheet 203. Holding portions 201*b*, 201*c* and 201*d* allow a user to hold image forming unit 110Y along with exterior cover sheet 201. Folding along folding lines 201*e* and 201*f* forms entire exterior cover sheet 201 in a U-shape, having holding portions 201*b* and 201*c*, that fits from the upper part to both sides of image forming unit 110Y as shown in FIG. 2.

Holding portions 201*b* and 201*c* of exterior cover sheet 201 are cut at the right end portions into insertion end portion 201*a*. The shape is formed to prevent interference of exterior cover sheet 201 with a protrusion (not shown in the figure) on apparatus main unit 101, when the insertion end portion of image forming unit 110Y is inserted into apparatus main unit 101. When no protrusion is provided on apparatus main unit 101, holding portions 201*b* and 201*c* need not to be cut out and may be formed as a same surface of insertion end portion 201*a*.

When image forming unit 110Y is inserted into the opening on apparatus main unit 101 for image forming unit 110Y attachment, insertion end portion 201*a* of exterior cover sheet 201 having the shape described above touches the exterior wall near the opening for image forming unit 110Y attachment, thereby stopping the insertion operation of image forming unit 110Y and letting the user know the timing to remove entire protective cover 200 along with buffer sheet 202 and blackout sheet 203.

The shape of exterior cover sheet 201 allows the user to easily hold image forming unit 110Y along with holding portions 201*b*, 201*c* and 201*d*, when inserting image forming unit 110Y into the opening on apparatus main unit 101 for image forming unit 110Y attachment. Further, the shape allows the user to easily know the timing to remove entire protective cover 200, while inserting the insertion end portion of image forming unit 110Y into the opening on apparatus main unit 101 for image forming unit 110Y attachment.

Exterior cover sheet 201 therefore provides a holding function for replacement and a stop function during insertion, when image forming unit 110Y is attached to apparatus main unit 101.

Buffer sheet 202 is made of one sheet of foamed polyethylene that absorbs shock and easily cuts in one direction. Thus, buffer sheet 202 protects the surface of photoconductive drum 111Y from being damaged as strongly pressed by the rear side of blackout sheet 203 when the user holds both sides of image forming unit 110Y along with holding portions 201*b*, 201*c* and 201*d* of exterior cover sheet 201.

As shown in FIG. 3, buffer sheet 202 includes insertion end portion 202*a*, cover portion 202*b* and adhesion portion 202*c*. Insertion end portion 202*a*, having a light-shielding function as its surface blocks out light, is inserted along with the insertion end portion of image forming unit 110Y. Substantially triangle-shaped cover portion 202*b*, extending upwardly from holding portion 201*c* of exterior cover sheet 201, covers the substantially entire circumference of image forming unit 110Y from the lower part as shown in FIG. 2. Adhesion portion 202*c*, located on the upper side of cover portion 202*b* in the figure, adheres to the surface of holding portion 201*c* of exterior cover sheet 201, using adhesive tape 204. Adhesion portion 202*c* provided on buffer sheet 202 allows the user to peel adhesive tape 204, remove adhesion portion 202*c* from cover portion 202*b* and easily remove entire protective cover 200, while exterior cover sheet 201 stops the insertion operation of image forming unit 110Y. Further, adhesive tape 204 has non-adhesive portion 204*a* formed folding the light end portion as shown in FIG. 3, allowing the user to peel adhesive tape 204 easily.

Buffer sheet 202 therefore provides a protection function that guards the surface of photoconductive drum 111Y; a light-shielding function that blocks out outside light that may fall on the surface of photoconductive drum 111Y; and a function that allows easy removal of entire protective cover 200, when image forming unit 110Y is attached to apparatus main unit 101.

As shown in FIG. 6 (*b*), the front side of substantially rectangular blackout sheet 203, which overlaps the rear side of buffer sheet 202 shown in the figure, adheres to the rear side of buffer sheet 202. Further, blackout sheet 203 is formed having a size that covers the exposed portion of photoconductive drum 111Y, that is, the portion exposed to outside light during the time from when image forming unit 110Y is taken out of a package and until attached to apparatus main unit 101.

Therefore, blackout sheet 203, made of one sheet of light-shielding polyethylene colored black that substantially completely shuts out light, provides a light-shielding function that substantially completely shields the exposed portion of photoconductive drum 111Y from outside light, when image forming unit 110Y is attached to apparatus main unit 101. Thereby, blackout sheet 203 is able to prevent exposure even when image forming unit 110Y is placed under outside light for a long period of time.

Described below are operation procedures for attaching image forming unit 110Y covered with protective cover 200 shown in FIG. 2 to apparatus main unit 101 in reference to FIGS. 7 to 9.

Figure 7:
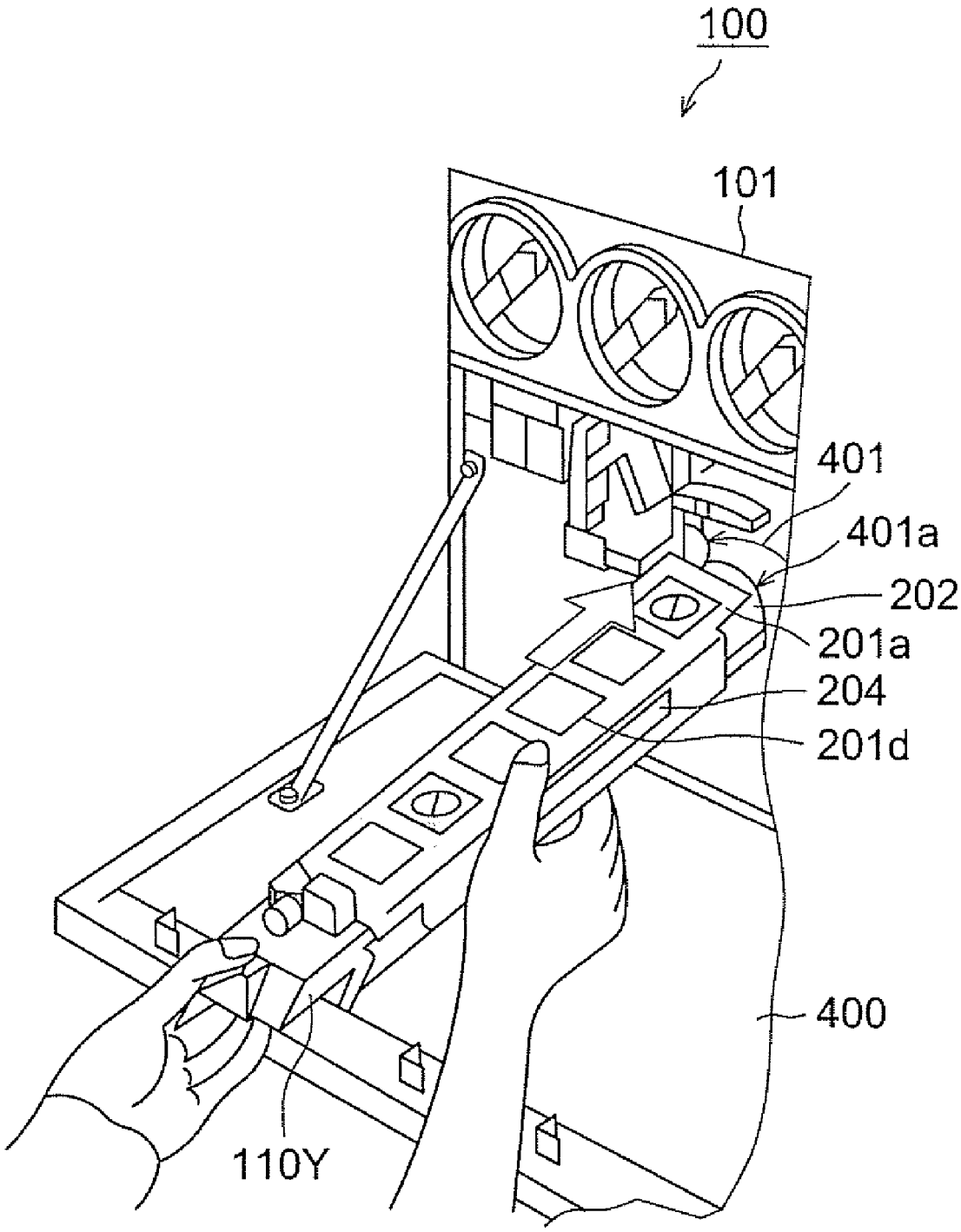
FIG. 7 illustrates a first operation procedure for attaching to the apparatus an image forming unit according to the embodiment.

FIG. 7 shows a first step to attach image forming unit 110Y covered with protective cover 200 to apparatus main unit 101.

Prior to the operation shown in FIG. 7, the user opens front cover 400 of apparatus main unit 101 of image forming apparatus 100 toward front and removes used image forming unit 110Y from attachment 401. Then, as shown in FIG. 7, the user holds with the user's left hand the front end portion of image forming unit 110Y covered with protective cover 200 for replacement; and with the user's right hand holding portion 201*d* on the upper side of exterior cover sheet 201 and the lower part covered with buffer sheet 202. The user then inserts insertion end portion 201*a* of exterior cover sheet 201 of protective cover 200 into opening 401*a* of attachment 401, in the direction of an arrow shown in the figure.

A holding method shown in FIG. 7 is one example; the user may hold other portions of protective cover 200.

Figure 8:
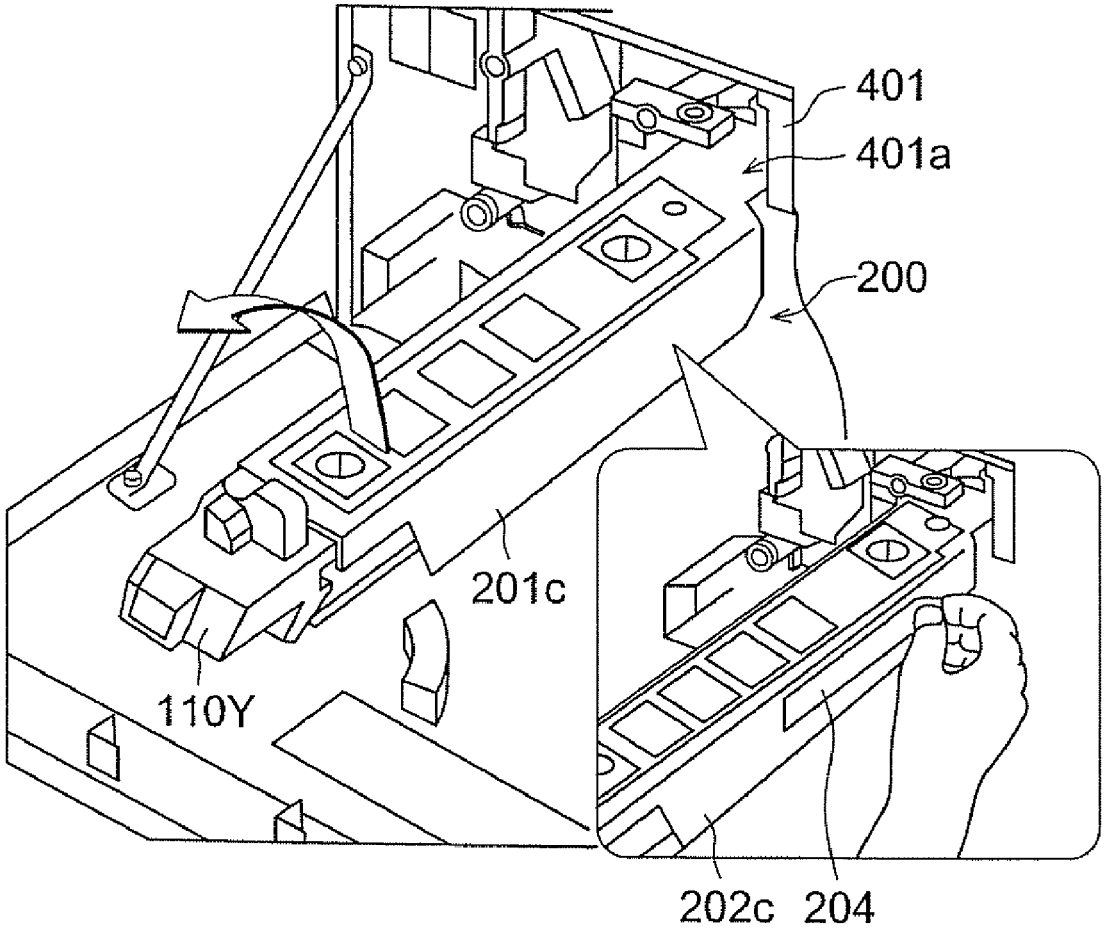
FIG. 8 illustrates operation procedures for inserting into the apparatus the image forming unit according to the embodiment and removing the protective cover.

FIG. 8 illustrates the insertion end portion of image forming unit 110Y, covered with protective cover 200 for replacement, inserted into opening 401*a* of attachment 401 on apparatus main unit 101 along with insertion end portion 201*a* of exterior cover sheet 201.

As shown in FIG. 8, when the user inserts the insertion end portion of image forming unit 110Y covered with protective cover 200, along with buffer sheet 202 and blackout sheet 203, into opening 401*a* of attachment 401 on apparatus main unit 101, insertion end portion 201*a* of exterior cover sheet 201 touches the exterior wall (not shown in the figure) near opening 401*a* of attachment 401 for image forming unit 110Y on apparatus main unit 101. Then, the insertion operation of image forming unit 110Y stops and the insertion end of image forming unit 110Y is held supported on the wall inside opening 401*a*.

Since the insertion operation of image forming unit 110Y stops, the user knows the timing to remove protective cover 200. Then, as shown in an enlarged part of FIG. 8, the user pinches non-adhesive portion 204*a* of adhesive tape 204 adhered to adhesion portion 202*c* of buffer sheet 202; peels the tape toward front; and removes adhesion portion 202*c* of buffer sheet 202 from cover portion 202*b*.

Thereby, buffer sheet 202 that covers the substantially entire circumference of image forming unit 110Y can be removed from the circumference of image forming unit 110Y. Blackout sheet 203 that covers the exposed portion of photoconductive drum 111Y can also be removed. Lifting exterior cover sheet 201 in the direction of an arrow shown in the figure can easily remove entire protective cover 200 from image forming unit 110Y.

Figure 9:
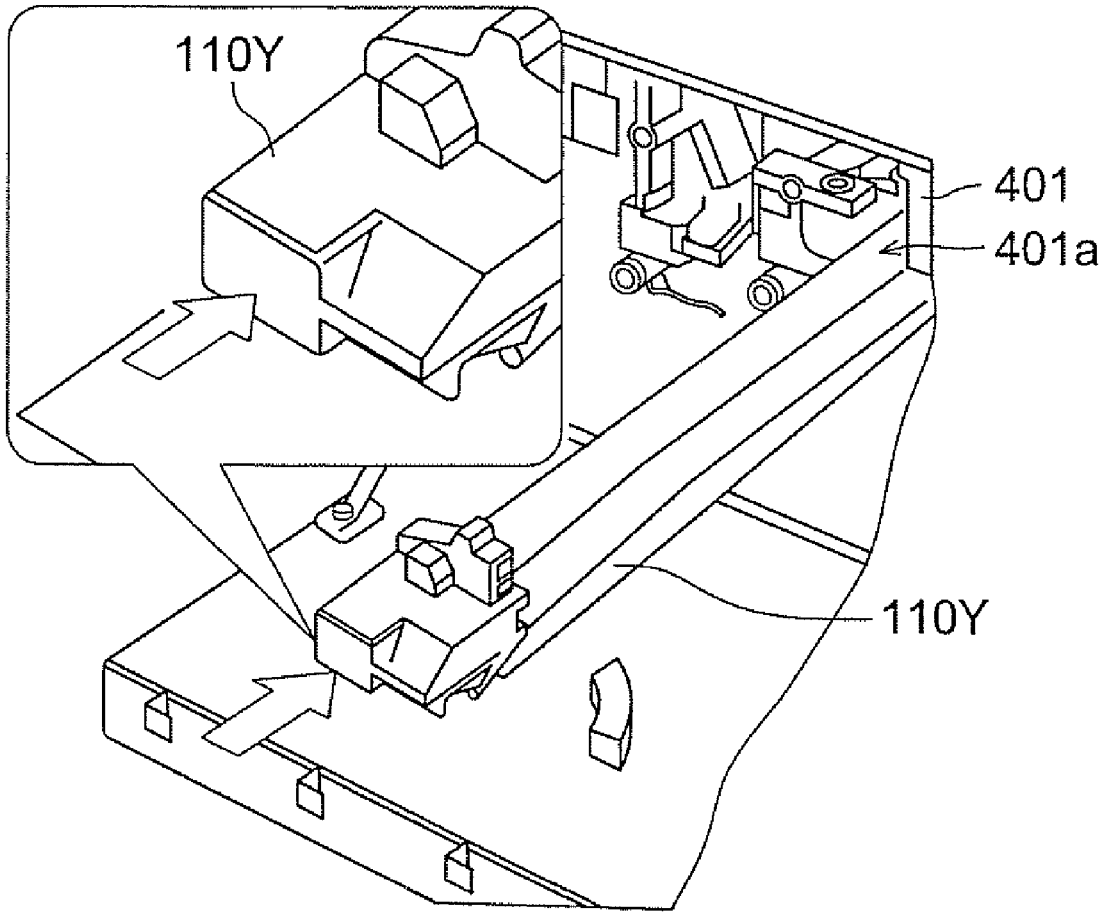
FIG. 9 illustrates operation procedures for inserting into the apparatus the entire image forming unit according to the embodiment.

FIG. 9 illustrates image forming unit 110Y inserted into opening 401*a* of attachment 401 on apparatus main unit 101 after protective cover 200 is uncovered.

As shown in FIG. 9, the user pushes the front end portion of image forming unit 110Y in the figure in the direction of an arrow and stows entire image forming unit 110Y in opening 401*a* of attachment 401 on apparatus main unit 101.

Then, the user can dispose of protective cover 200 removed from image forming unit 110Y.

The operation procedures shown in FIGS. 7 to 9 complete replacement of image forming unit 110Y. Image forming units 110M, 110C and 110K may be replaced following the same operation procedures.

As described above, the protective cover that covers the image forming unit according to the embodiment is attached to the image forming unit until the insertion end portion of the image forming unit is halfway inserted into the apparatus main unit, and then the entire protective cover is removed when the exterior cover sheet touches the exterior wall of the apparatus main unit.

Therefore, when inserting the image forming unit into the apparatus main unit, the user is able to know the timing to remove the protective cover, since the insertion operation stops, and is able to remove the protective cover easily. Further, when the insertion end portions of the buffer sheet and the blackout sheet, which constitute the protective cover, are inserted into the apparatus main unit along with the image forming unit, the exterior cover sheet touches the exterior wall of the apparatus main unit, thereby preventing the user from inserting the protective cover inadvertently deeply into the apparatus main unit.

Furthermore, the sheet-type protective cover does not require the image forming unit to have a cover guide or the like that slides and fits into the protective cover, thereby reducing manufacturing costs of the protective cover, compared to a plastic product, thus reducing manufacturing costs of the image forming unit.

The protective cover according to the embodiment includes: the exterior cover sheet that provides the holding function for replacement and the stop function during insertion, when the image forming unit is attached to the apparatus main unit; the buffer sheet that provides the protection function to guard the surface of the photoconductive drum, the light-shielding function to shield the photoconductive drum surface from light, and the function to allow easy removal of the entire protective cover; and the blackout sheet that provides the light-shielding function to substantially completely shield the exposed portion of the photoconductive drum from outside light.

Thus, when the image forming unit is replaced, the photoconductive drum surface is prevented from being damaged and the exposed portion of the photoconductive drum is shielded from outside light. Therefore, the user is able to easily replace the image forming unit and remove the protective cover. Further, the protective cover is made of the cardboard sheet, the foamed polyethylene sheet and the light-shielding polyethylene sheet. Therefore, the user is able to dispose of an unwanted protective cover, which is also suitable for environmental protection.

Although the embodiment above shows the protective cover having the three layer structure, it is also possible to form a two layer structure having the exterior cover sheet and the buffer sheet. The two layer structure allows manufacturing of the protective cover at lower cost, which is also preferable to environmental protection.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2005-088056 filed on Mar. 25, 2005, entire content of which is expressly incorporated by reference herein.

What is claimed is:

1. A process cartridge attachable to and detachable from an image forming apparatus, the process cartridge comprising:

a photoconductor configured to receive an electrostatic latent image on a surface of the photoconductor;

a first sheet-type protective cover, configured to be provided about the photoconductor, before the process cartridge is attached to the image forming apparatus, the first sheet-type protective cover being configured to protect the surface of the photoconductor and to shield the surface of the photoconductor from light; and a second sheet-type protective cover, configured to be provided about the photoconductor, before the process cartridge is attached to the image forming apparatus, the second sheet-type protective cover being configured to be positioned outwardly of the first sheet-type protective cover and to have a predetermined portion, the predetermined portion being configured to contact a portion of the image forming apparatus during attachment of the process cartridge to the image forming apparatus, the predetermined portion being configured to stop attachment of the process cartridge to the image forming apparatus, stopping the attachment serving as an indication to an installer of the process cartridge, that the second sheet-type protective cover, together with the first sheet-type protective cover can be removed from the process cartridge.

2. The process cartridge according to claim 1, wherein the first sheet-type protective cover comprises a foamed polyethylene sheet.

3. The process cartridge according to claim 1, wherein the second sheet-type protective cover comprises a cardboard.

4. The process cartridge according to claim 1 further comprising a third sheet-type protective cover configured to be provided between the surface of the photoconductor and the first sheet-type protective cover, and to shield the surface of the photoconductor from light.

5. The process cartridge according to claim 4, wherein the third sheet-type protective sheet comprises a light-shielding polyethylene sheet.

6. The process cartridge according to claim 1, wherein said second sheet type protective cover includes insertion direction indicia provided on the predetermined portion.

7. The process cartridge according to claim 1, wherein said first sheet-type protective cover and said second sheet-type protective cover are attached to each other, whereby the first and second sheet-type protective covers are configured to be concurrently removed from the process cartridge.

8. The process cartridge according to claim 1, wherein each of the first and second sheet-type protective covers have a size, in a direction extending about a periphery of the process cartridge less than a peripheral surface of the process cartridge.

9. The process cartridge according to claim 1, wherein said second sheet-type protective cover comprises a rigid member configured to be bent at predetermined fold lines.

10. An image forming apparatus, comprising:

a housing;

a recording medium holder configured to hold a recording medium;

a feeder configured to feed the recording medium from the recording medium holder;

an opening in the housing configured to receive there through a process cartridge to be attached to the image forming apparatus, the process cartridge including a photoconductor configured to receive an electrostatic latent image on a surface thereof, the electrostatic latent image on the surface of the photoconductor being configured to be developed into a toner image, the developed toner image being transferred to the recording medium; and a fuser configured to fix the toner image on the recording medium fed by the feeder, the process cartridge further being configured to have provided thereabout, before the process cartridge is attached to the image forming apparatus, a first sheet-type protective cover and a second sheet-type protective cover, the first sheet-type protective cover being configured to protect the surface of the photoconductor and to shield the surface of the photoconductor from light, the second sheet-type protective cover configured to cover the first sheet-type protective cover, the second sheet-type protective cover having a predetermined portion, the predetermined portion being configured to contact a portion of the image forming apparatus adjacent to the opening of the housing of the image forming apparatus during attaching of the process cartridge, and to stop attachment of the process cartridge to the image forming apparatus, stopping the attachment serving as an indication, to a user of the process cartridge, that the second sheet-type protective cover together with the first sheet-type protective cover can be removed from the process cartridge.

11. A method for attaching a process cartridge to an image forming apparatus having a housing with an opening, the process cartridge including a photoconductor configured to receive an electrostatic latent image, the process cartridge being received within a protective cover comprising a first protective sheet and a second protective sheet, an outermost component of the protective cover having a predetermined portion at an end of the protective cover, the attaching method comprising:

locating the process cartridge, received within the protective cover, adjacent to the opening of the image forming apparatus to which the process cartridge is to be attached;

bringing the predetermined portion of the protective cover into contact with a portion of the image forming apparatus positioned within the opening, contact between the predetermined portion and a portion of the image forming apparatus stopping insertion of the process cartridge, received within the protective cover into the image forming apparatus;

removing the protective cover from the process cartridge by removing the first protective sheet and the second protective sheet from about the process cartridge; and inserting the process cartridge into the opening of the image forming apparatus.

12. The method according to claim 11, wherein bringing the predetermined portion of the protective cover into contact with a portion of the image forming apparatus comprises aligning an insertion direction indicia, provided on the predetermined portion, with the portion of the image forming apparatus.

13. The method according to claim 11, wherein removing the protective cover comprises removing an adhesive tape securing the protective cover about the process cartridge; and moving the protective cover in a direction away from the image forming apparatus.

14. The method according to claim 13, wherein removing the protective cover comprises moving the protective cover in a direction substantially transverse to a direction of insertion of the process cartridge into the opening of the image forming apparatus.

15. A cover for a process cartridge, the process cartridge including a photoconductor, the cover comprising:

a first protective cover configured to be received about the photoconductor before the process cartridge is attached to an image forming apparatus, the first protective cover being configured to protect the surface of the photoconductor and to shield the surface of the photoconductor from light; and a second protective cover configured to be received about the photoconductor before the process cartridge is attached to the image forming apparatus, the second protective cover being configured to be positioned outwardly of the first protective cover, a predetermined portion provided at an end of the second protective cover, the predetermined portion including insertion direction indicia and being configured for contacting a portion of the image forming apparatus to stop the stepping attachment of the process cartridge to the image forming apparatus, stopping the attachment serving as an indication, to a user of the process cartridge, that the second protective cover together with the first protective cover can be removed from the process cartridge and that the attachment can be completed.

16. The cover according to claim 15, further comprising a third protective cover configured to be positioned between the surface of the photoconductor and the second protective cover and to shield the surface of the photoconductor from light.

17. The cover according to claim 16, wherein said first protective cover, said second protective cover and said third protective cover are secured together, whereby the first, second and third protective covers can be concurrently removed from the process cartridge.

18. The cover according to claim 15, the second protective cover comprising a rigid member configured to be bent at a predetermined fold line.

19. The cover according to claim 15, wherein the first protective cover and the second protective cover are attached to each other so that the first and second protective covers can be concurrently positioned about and removed from the photoconductor.

* * * * *